US009534873B2

(12) United States Patent
Urban

(10) Patent No.: US 9,534,873 B2
(45) Date of Patent: Jan. 3, 2017

(54) REMOTE CONTROLLED TARGET SYSTEM

(71) Applicant: Robert Urban, Woodland Park, CO (US)

(72) Inventor: Robert Urban, Woodland Park, CO (US)

( * ) Notice: Subject to any disclaimer, the term of this patent is extended or adjusted under 35 U.S.C. 154(b) by 0 days.

(21) Appl. No.: 14/952,915

(22) Filed: Nov. 25, 2015

(65) Prior Publication Data

US 2016/0146581 A1 May 26, 2016

Related U.S. Application Data

(60) Provisional application No. 62/084,009, filed on Nov. 25, 2014.

(51) Int. Cl.
*F41J 7/00* (2006.01)
*F41J 1/10* (2006.01)

(52) U.S. Cl.
CPC .... *F41J 1/10* (2013.01); *F41J 7/00* (2013.01)

(58) Field of Classification Search
CPC ..... F41J 1/00; F41J 1/10; F41J 7/00–7/04; F41J 3/0004
USPC ..... 273/403–410
See application file for complete search history.

(56) References Cited

U.S. PATENT DOCUMENTS 398,186 A * 2/1889 Rehfuss ..... F41J 1/10 273/404
840,610 A * 1/1907 Easdale ..... F41J 13/00 273/404
1,928,768 A * 10/1933 Sell ..... F41J 3/0076 273/317.2
1,981,293 A 11/1934 Varrelman
2,034,839 A 3/1936 Sheffield
2,048,155 A 7/1936 Armantrout
2,294,730 A * 9/1942 Eggers ..... G01P 3/685 250/224
2,466,686 A 4/1949 Connelly
3,014,725 A 12/1961 Lewis
3,519,272 A 7/1970 Vogelaere
4,247,116 A 1/1981 McQuary
4,317,572 A * 3/1982 Iseli ..... F41J 13/00 273/404
4,523,761 A * 6/1985 Huscher ..... F41J 5/02 226/20
4,548,414 A * 10/1985 Denis ..... F41J 7/06 273/359
5,169,157 A 12/1992 Salmon
5,829,753 A * 11/1998 Wiser ..... F41J 1/10 273/407
6,257,584 B1 7/2001 Nasuti
6,543,778 B2 4/2003 Baker
7,374,173 B2 * 5/2008 Nasuti ..... F41J 1/10 273/403

(Continued)

FOREIGN PATENT DOCUMENTS

WO 2010119440 A1 10/2010

*Primary Examiner* — Mark Graham
(74) *Attorney, Agent, or Firm* — Faegre Baker Daniels LLP

(57) ABSTRACT

In certain embodiments, a system includes a frame with top, middle, and bottom sections. The system further includes a first roller section coupled to the frame and positioned at the top section of the frame. A second roller section is coupled to the frame and positioned at the middle section of the frame. One of the first and second roller sections includes a battery, wireless receiver, motor, and optical sensor.

15 Claims, 16 Drawing Sheets

(56) References Cited

U.S. PATENT DOCUMENTS

| | | | | |
|---|---|---|---|---|
| 7,784,794 | B2 | 8/2010 | Sitton | |
| 8,141,878 | B2 | 3/2012 | Kuyl | |
| 8,910,944 | B2 | 12/2014 | Mason et al. | |
| 9,010,760 | B2 | 4/2015 | McMillan et al. | |
| 9,255,773 | B1 * | 2/2016 | Hall | F41J 7/00 |
| 2006/0290064 | A1 | 12/2006 | Hagar | |
| 2008/0211190 | A1 * | 9/2008 | Smith | F41J 1/10 273/407 |
| 2009/0026708 | A1 * | 1/2009 | Sitton | F41J 3/0004 273/403 |
| 2013/0228975 | A1 * | 9/2013 | Mason, III | F41J 1/10 273/406 |

* cited by examiner

REMOTE CONTROLLED TARGET SYSTEM

CROSS REFERENCE TO RELATED APPLICATION

This application claims the benefit under 35 U.S.C. §119 of U.S. Provisional Application No. 62/084,009, filed Nov. 25, 2014, entitled "Remote Controlled Repeating Target System," which is hereby incorporated by reference in its entirety.

BACKGROUND

Target shooting often involves shooting at a variety of targets like cans and bottles. Once the targets have been shot, the targets need to be replaced by resetting the targets or setting up new targets. This requires target shooters to walk back and forth to the target area. This also typically results in the shot targets to be left in the target area as litter.

SUMMARY

Aspects of the present disclosure address such problems and more. The present disclosure features a target system that can be remotely controlled to rotate through a series of targets printed on target paper. The target system can utilize a frame with various roller sections coupled to the frame. Roller sections can include a motor to rotate a tube of target paper to advance through targets.

Certain embodiments include a system having a frame with a top, middle, and bottom section. A first roller section is coupled to the frame at the top section and a second roller section is coupled to the frame at the middle section. At least one of first and second roller sections includes a battery, wireless receiver, motor, and optical sensor.

Certain embodiments include using a target system having a frame coupled to first and second roller sections with a roll of target paper extending between the first and second roller sections. The target paper may include first and second targets with associated detectable marks. The method includes sending a command signal to a wireless receiver positioned in the first roller section. In response to receiving the command signal, the method includes sending a power signal to a motor positioned in the first roller section. In response to receiving the power signal, the method rotates a shaft of the motor coupled to the roll of target paper. The first target gets rolled while the second target is unrolled.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

Figure 1:
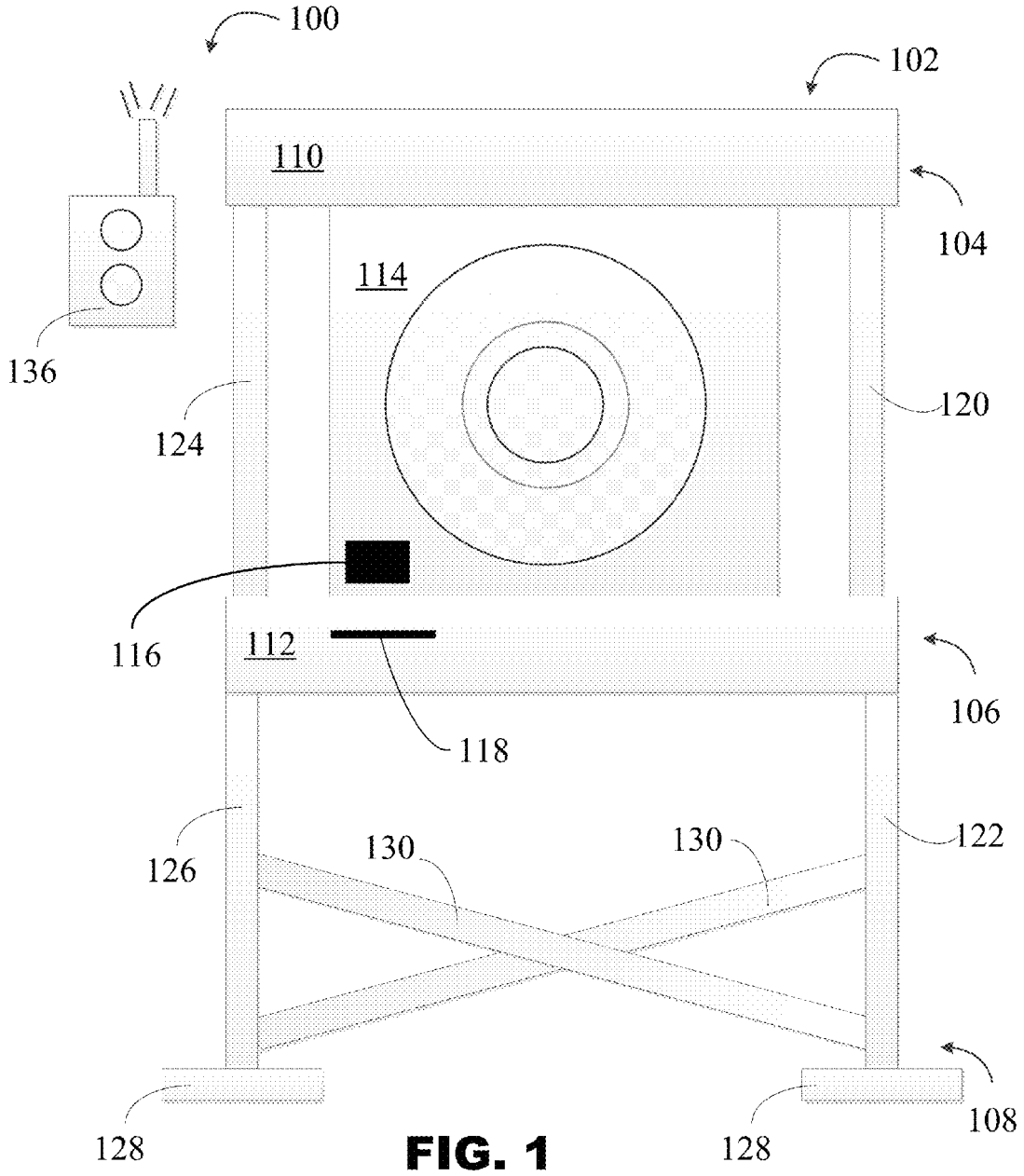
FIG. 1 shows a front view of a remote controlled target system, in accordance with certain embodiments of the present disclosure.

While the disclosed subject matter is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

As the terms are used herein with respect to ranges of measurements (such as those disclosed immediately above), "about" and "approximately" may be used, interchangeably, to refer to a measurement that includes the stated measurement and that also includes any measurements that are reasonably close to the stated measurement, but that may differ by a reasonably small amount such as will be understood, and readily ascertained, by individuals having ordinary skill in the relevant arts to be attributable to measurement error, differences in measurement and/or manufacturing equipment calibration, human error in reading and/or setting measurements, adjustments made to optimize performance and/or structural parameters in view of differences in measurements associated with other components, particular implementation scenarios, imprecise adjustment and/or manipulation of objects by a person or machine, and/or the like.

DETAILED DESCRIPTION

Figure 2:
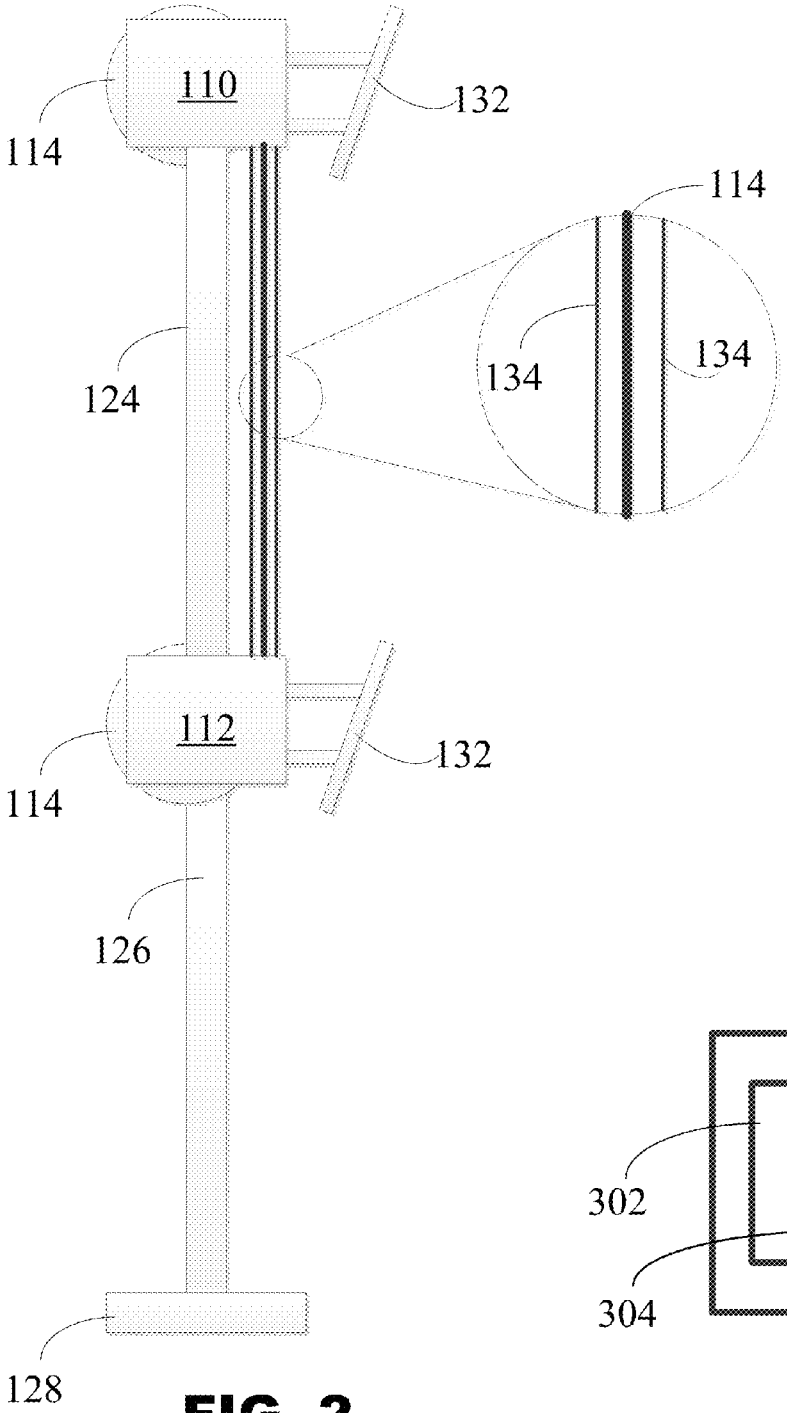
FIG. 2 shows a side view of the remote controlled target system of FIG. 1, in accordance with certain embodiments of the present disclosure.

FIGS. 1 and 2 show front and side view of a target system 100 with a frame 102 having top 104, middle 106, and bottom sections 108. Coupled to the top section 104 is a first roller section 110, and coupled to the middle section 106 is a second roller section 112—both of which will be described in greater detail below. Extending between the first and second roller sections 110, 112 is a roll of target paper 114, which features a set of shooting targets and associated alignment marks 116. The second roller section 110 also includes an optical sensor 118, which will be described in greater detail below, that is aligned with alignment marks 116 on the shooting target paper 114. In embodiments, the optical sensor 118 may be included in the first roller section 110 (in which case, alignment marks 116 may be located above the associated shooting target).

Although the first and second roller sections 110 and 112 are shown as being oriented laterally, so that the paper travels vertically, in embodiments, the system 100 may be configured such that the first and second roller sections 110 and 112 are each oriented vertically, or at least approximately vertically, so that the paper travels laterally (e.g., horizontally). In this manner, for example, the system 100 may be used to simulate a moving animal target. That is, for example, the system may be configured to continuously roll the target from one side to the other, and include drawings of an animal thereon (e.g., a rabbit or squirrel) so that movement of the animal is simulated. According to embodiments, the system 100 may be configured to be adjustable so that the paper travels laterally, vertically, or at an angle, depending on the particular configuration that the user chooses when assembling the system 100 for use.

The frame 102 includes a first set of legs 120, 122 positioned on a first side of the frame 102 and includes a second set of legs 124, 126 positioned on a second side of the frame 102. The bottom section 108 of the frame includes base plates 128 that may, in embodiments, include anchoring structures that anchor the target system 100 to the ground or a base. The anchoring structure can include holes for inserting anchors (e.g., stakes, bolts, etc.) therethrough for further anchoring the frame 102 to the ground or a base. In embodiments, the lower legs 122 and 126 may fit into slots formed in the base plates 128. In other embodiments, the lower legs 122 and 126 may be pivotably coupled to the base plates, as shown, for example, in FIGS. 8A-8B. Any other mechanism for coupling the lower legs 122 and 126 to the base plates 128 may be used in embodiments. Extending between lower legs 122 and 126 are support structures 130 that provide additional rigidity to the frame 102 by coupling the bottom legs to each other and/or the base plates. The legs 120-26 and various structures of the frame vulnerable to being struck by an errant bullet can be angled to mitigate damage and unwanted ricochet should a bullet strike the frame 102. Additionally, or alternatively, parts of the frame may be constructed of materials suitable for withstanding bullet impacts such as, for example, reinforced steel coated with compressed rubber.

FIG. 2 shows shields 132, which protect the first and second roller sections from becoming damaged from bullets. The shields 130 can include a layer of compressed rubber that absorbs contact from bullets and covers another layer or structure made of metal like steel. The materials forming the shields may be configured to withstand, absorb, and/or stop, bullets of any number of different calibers, velocities, and/or the like. The shields are angled (e.g., 45 degrees, or any other desired degree) so that, if hit by a bullet, the bullet would be directed down towards the ground instead of ricocheting back towards the target shooter.

Figure 3:
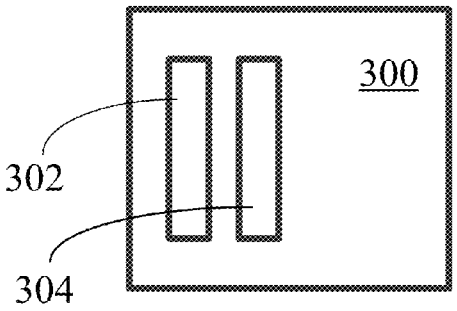
FIG. 3 shows a bottom view of a housing, in accordance with certain embodiments of the present disclosure.

FIG. 3 shows a bottom side of a housing-like structure 300 that can form part of the roller sections and assist with coupling parts of the frame together. The structure 300 includes slots 302, 304 that are shaped to accept ends of legs 120-126. For example, a bottom end of leg 124 may fit into slot 302 while a top end of leg 126 may fit into slot 304 resulting in the legs being coupled together. Another structure similar to 300 could be used to couple legs 120 and 122 together. The structure 300 may include posts in or around the slots that ensure that someone assembling the frame positions and orients the legs and housing-like structure 300 properly. For example, if the structure 300 includes a rotatable motor (as will be discussed in more detail below), the structure 300 should be oriented such that the motor rotates in the desired direction. Posts or similar structures can be positioned in and around slots so that only the intended parts fit into slots. In certain embodiments, each roller section includes two housing-like structures that couple the roller section to the frame.

Moving back to FIG. 2, target paper 114 is shown extending from the first roller section 110 to the second roller section 112. In the close-up portion of FIG. 2, target paper 114 is positioned between two windscreens 134. The windscreens 134 can be secured to the frame and are configured to assist with maintaining a position of the target paper 114 that is extended between the roller sections. In embodiments, the windscreens 134 may be coupled to the upper legs 120, 124, the first roller section 110, and/or the second roller section 112, using any number of fastening devices such as, for example, snaps, grommets, clips, hook-and-loop fastening mechanisms (e.g., Velcro®), and/or the like.

Figure 4:
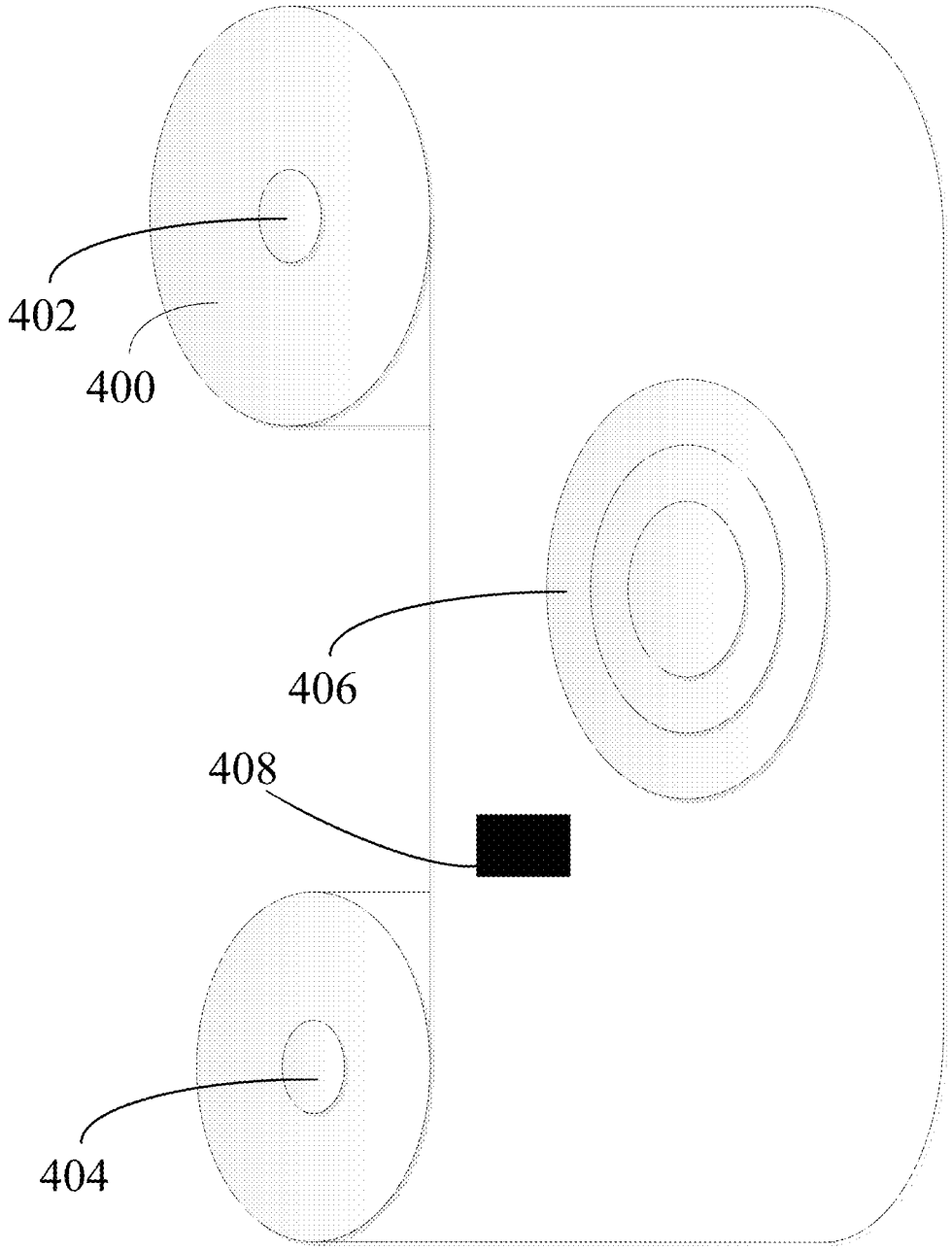
FIG. 4 shows a roll of target paper, according to certain embodiments of the present disclosure.
Figure 5:
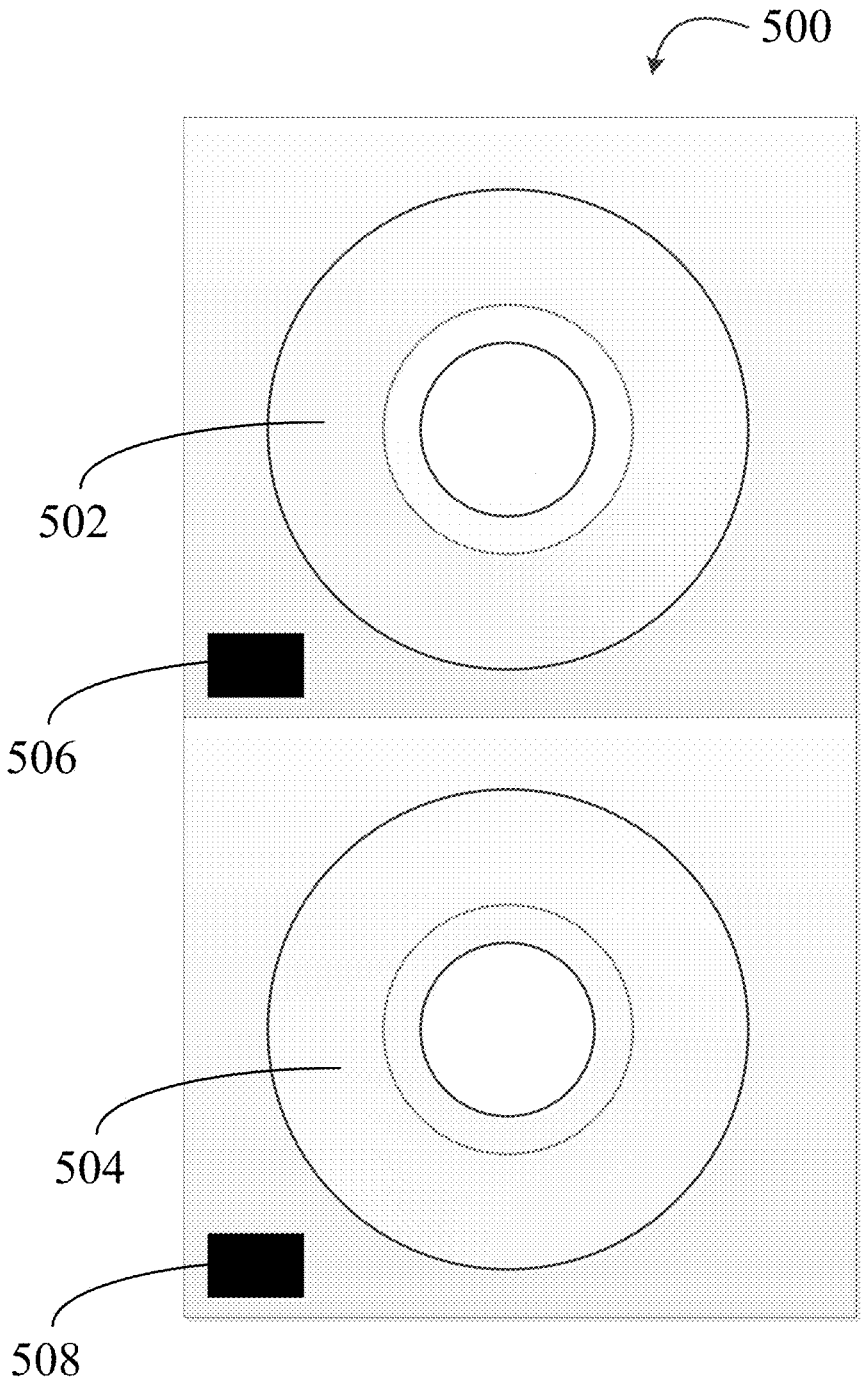
FIG. 5 shows a partial ribbon of unrolled target paper, according to certain embodiments of the present disclosure.

The target paper 114 can be rolled around a first tube positioned in the first roller section 110 and a second tube positioned in the section roller section 112. For example, FIG. 4 shows a roll of target paper 400 that is partially rolled around two tubes 402, 404. The target paper has a section that is unrolled and that features a target 406 and a detectable alignment mark 408 associated with the target 406. Although targets are shown as bullseyes, the targets can be a wide variety of patterns. Moreover, the target paper can have a number of targets. For example, FIG. 5 shows a partial ribbon of unrolled target paper 500. The target paper 500 is shown having multiple targets 502 and 504. Each target is associated with a detectable alignment mark 506, 508. As will be described later, the detectable alignment marks assist with remote control of the target system.

Figure 6A:
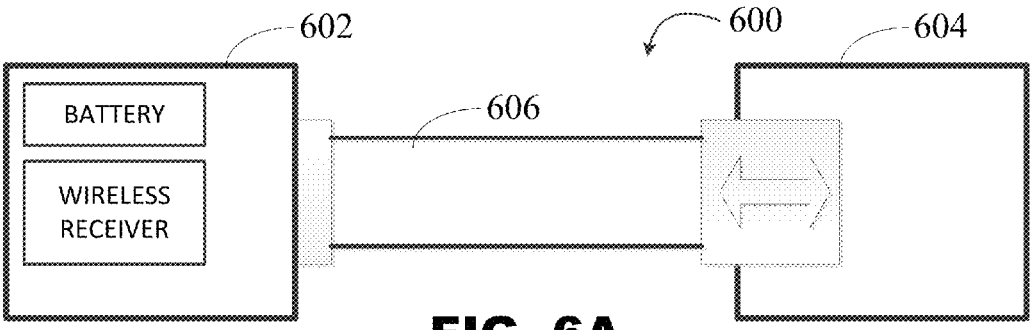
FIG. 6A shows an assembly of a roller section, in accordance with certain embodiments of the present disclosure.
Figure 6B:
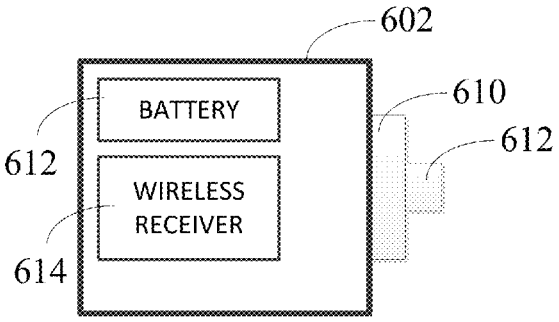
FIG. 6B shows a schematic front view of a motor housing, in accordance with certain embodiments of the present disclosure.
Figure 6C:
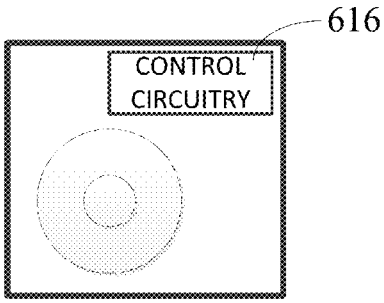
FIG. 6C shows a schematic side view of the motor housing of FIG. 6B.
Figure 6D:
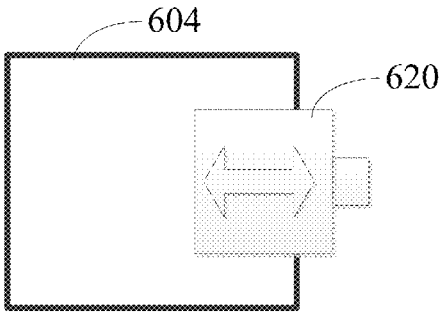
FIG. 6D shows a schematic front view of a spring-loaded housing, in accordance with certain embodiments of the present disclosure.
Figure 6E:
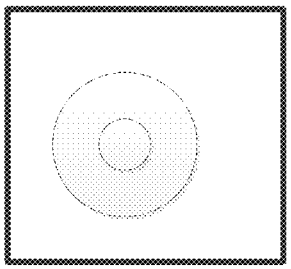
FIG. 6E shows a schematic side view of the spring-loaded housing of FIG. 6D.

FIGS. 6A-6E show various aspects of a roller section, according to certain embodiments. FIG. 6A shows a motor housing and spring-loaded housing coupled to a roll of target paper. FIG. 6B shows a schematic front view and FIG. 6C shows a schematic side view of motor housing in a roller section. FIG. 6D shows a schematic front view and FIG. 6E shows a schematic side view of spring-loaded housing in a roller section.

FIG. 6A shows a roller section 600 having a motor housing 602 and spring-loaded housing 604. Extending between the housings is a roll of target paper 606. The roll of target paper 606 is typically coupled to at least one tube. Tubes may feature protrusions or indentations positioned at ends of the tube that are formed to fit into or accept similar features. For example, a tube may have a series of indents that accept protrusions formed in parts or adapters of shafts positioned at each end of the tube. The protrusion and indents couple together such that the tube and shafts are, at least temporarily, secured to one another and able to rotate with each other.

FIGS. 6B-6C show a motor housing 602 including a motor 610, battery 612, wireless receiver 614, and control circuitry 616 that are electrically coupled to each other. The motor 610 includes a shaft 618 that rotates. The motor 610 is powered by the battery 612, which can be rechargeable. If the battery is rechargeable, the motor housing can include a charging port. In some embodiments, the motor 610 is powered by 12V direct current, although Applicant appreciates that other suitable motors and power supplies may be applicable. The wireless receiver 614 is configured to receive commands/signals from a remote transmitter like transmitter 136 shown in FIG. 1. For example, the receiver 614 could be configured to receive a command signal indicating that the motor should be powered on. Such a command may be handled by control circuitry 616.

FIGS. 6D-6E show a spring-loaded housing 604 having a spring-loaded and rotatable shaft 620. The spring housing 604 works in conjunction with the motor housing 602 to hold a rotate a roll of target paper. As previously discussed, a tube of target paper can extend from the motor housing 602 to the spring housing 604. The shaft 620 of the spring housing 604 can be moved in a horizontal direction to allow the tube of target paper to be inserted between the housing. The shaft can be coupled with an adapter that in shaped to accept and retain an end of a tube of target paper.

Figure 7A:
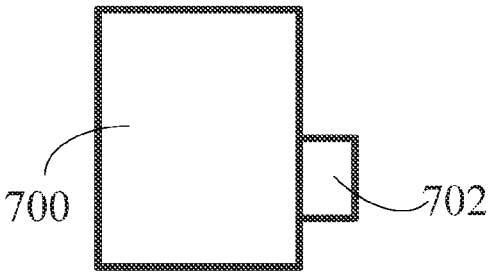
FIG. 7A shows a front view of a housing of a roller section, according to certain embodiments of the present disclosure.
Figure 7B:
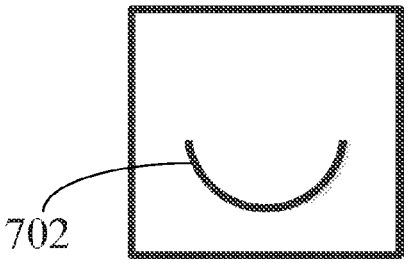
FIG. 7B shows a side view of the part shown in FIG. 7A.

FIG. 7A shows a front view and FIG. 7B shows a side view of part of a roller section, according to certain embodiments. The roller section can include a housing 700 having a pocket 702 that protrudes from the housing for a tube of roller paper to rest on and rotate. A roller section may have two housing such that both ends of a cylindrical tube of roller paper rest within a pocket. The various housings detailed in FIGS. 5-7B can include slots or other mechanically coupling features that couple parts of a frame together, like those discussed with respect to FIG. 3. For example, if housing 700 is positioned at a top section of a frame of the targeting system, the housing 700 may include slots formed in a bottom side of the housing that fit onto ends of legs. If housing 700 is positioned at a middle section of the frame of the targeting system, the housing 700 may include slots formed in both top and bottom sides to accommodate legs fitting into both top and bottom sides of the housing.

Figure 8A:
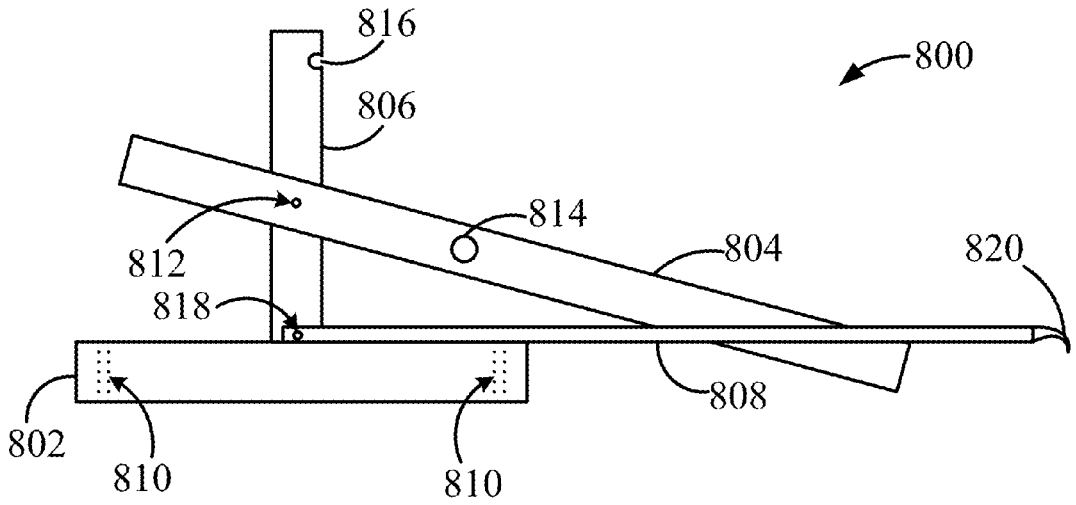
FIGS. 8A-C show various stages of assembling a target system, according to certain embodiments of the present disclosure.
Figure 8B:
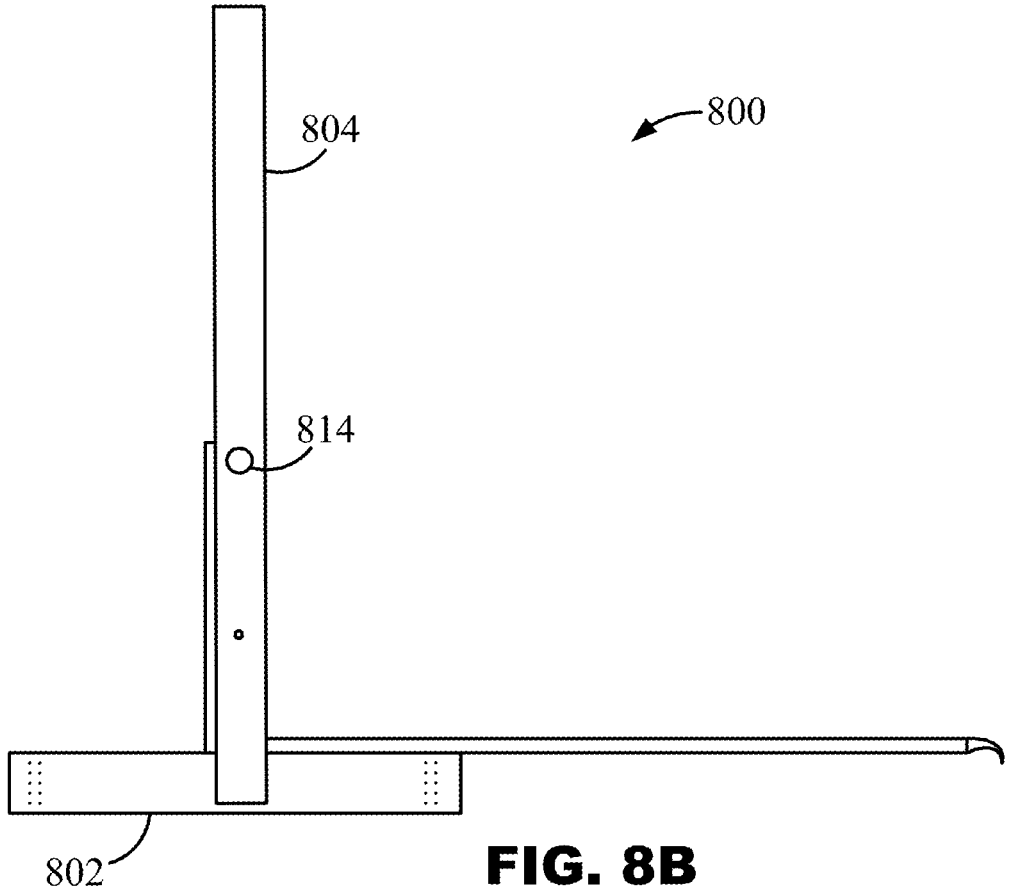
Figure 8C:
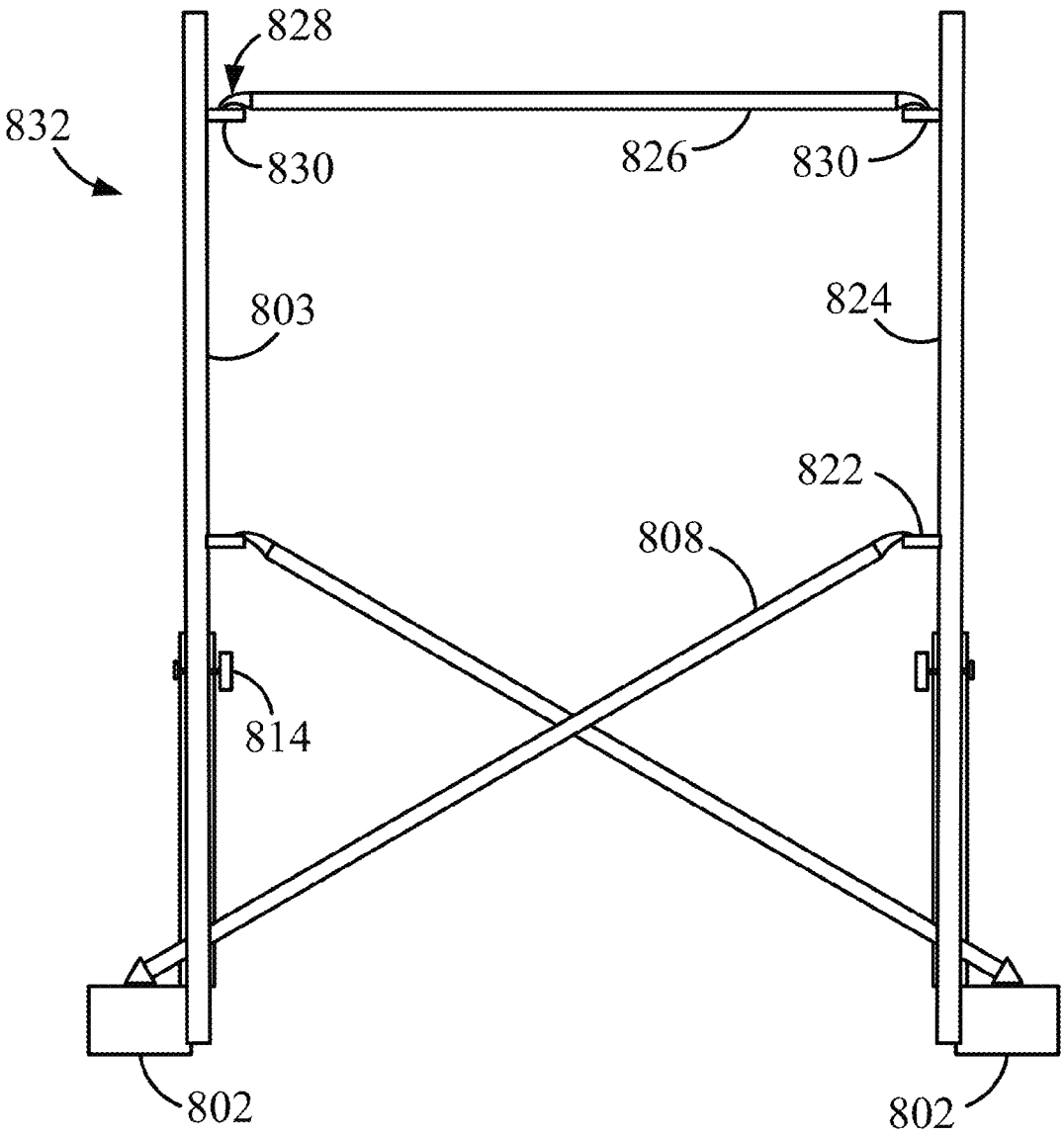

FIGS. 8A-C show various stages of assembling a bottom portion of a frame of a target system. FIG. 8A shows a leg component 800 in an unassembled stage while FIGS. 8B-C show different views of the bottom portion of the frame being assembled. The leg component 800 includes a base plate 802, leg 804, leg supporting structure 806, and diagonal support structure 808. The base plate 802 includes thru holes 810 that may receive various anchors that assist with anchoring the frame to the ground or a structure. The leg 804 includes a pivot support 812 and fastener structure 814 that engages with a notch 816 in the leg supporting structure 806. The diagonal support structure 808 includes a pivot support 818 and hook 820, which is configured to couple to another a hooking structure 822 coupled to another leg 824, as shown, for example, in FIG. 8C, to form the bottom portion 832 of the frame. The bottom portion 832 of the frame can also include a lateral support bar 826 featuring hooks 828 coupled to hooking structures 830 attached to legs 804, 824 for additional structural support. In embodiments, the lateral support bar 826 may be oriented horizontally, or at least substantially horizontally.

FIGS. 9A-H show various aspects of motor housings and mounting housings. FIGS. 9A-D show a motor housing 900 for positioning on one side of a frame of a target system while FIGS. 9E-H show another housing 940 for positioning on another side of the target system. As shown, embodiments housing 900 and the housing 940 may be similar in configuration. In embodiments, housing 900 and 940 may have any number of different features and/or configurations, may have similar features to one another, and/or may have different features than one another.

Motor housing 900 includes a main body 902 and a connector housing 904 coupled thereto. Main body 902 includes a front side 906, which may be angled downward so as to deflect bullets in a direction away from the target shooter. Main body 902 also includes a rear side 908, a top side 910, and a lower side 912. One or more leg adjustment mechanisms 914 may be disposed in a left side 916 of the connector housing 904, which may enable a user to secure a leg inside the connector housing 904, to adjust a characteristic of an interference fit between connector housing 904 and the leg, and/or the like.

Motor housing 900 includes a rotatable shaft assembly 920 that is shaped to receive a tube of target paper. The shaft assembly 920 can be moved towards the housing 900 to insert the tube. Once inserted, the shaft assembly 920 is spring loaded to provide a force that maintains a position of the tube in a horizontal, or at least substantially horizontal, direction.

Figures 9A, 9B, 9C, 9D:
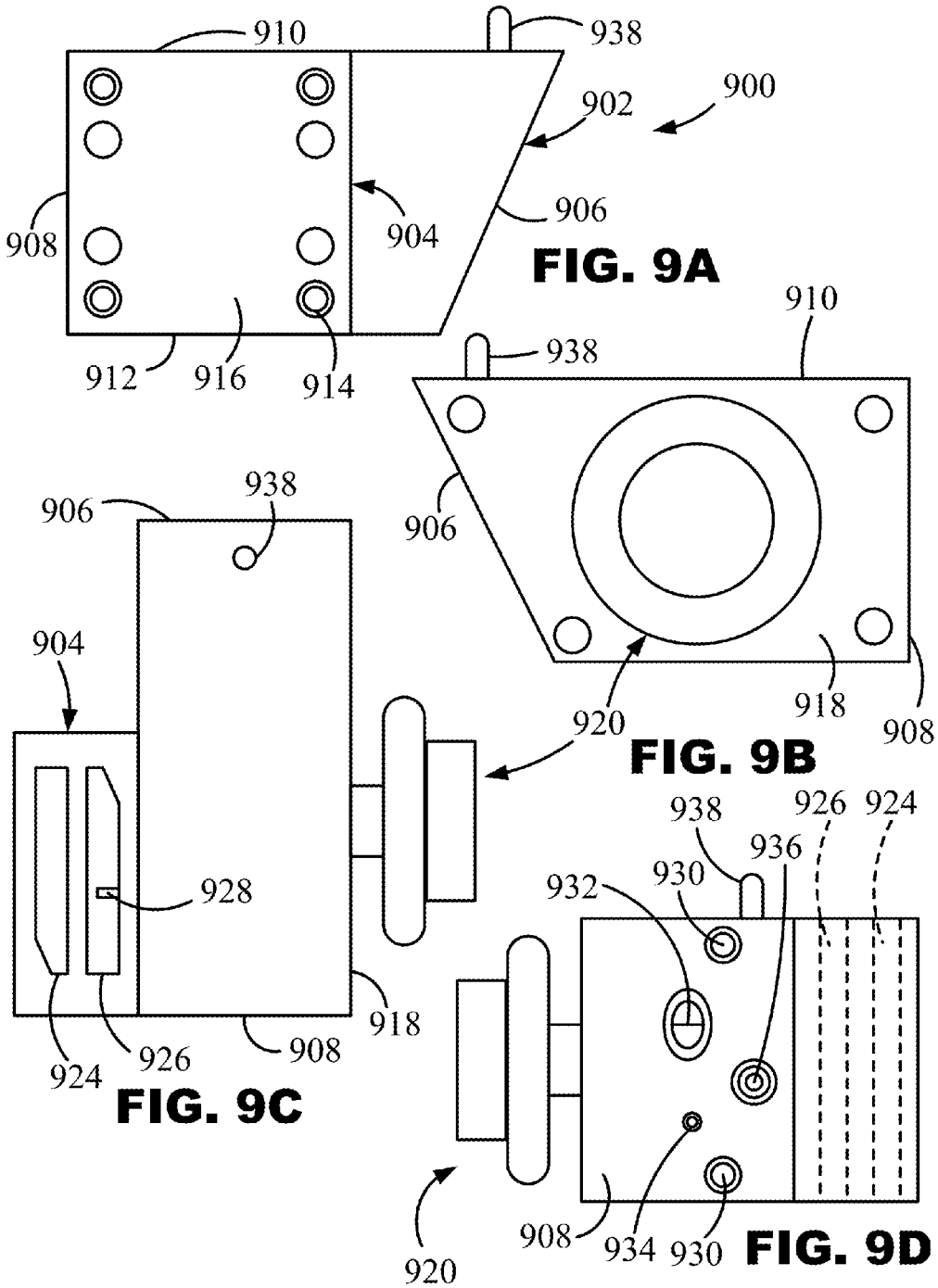
FIGS. 9A-H show various aspects of a spring-loaded and motor housings, according to certain embodiments of the present disclosure.
Figure 9E:
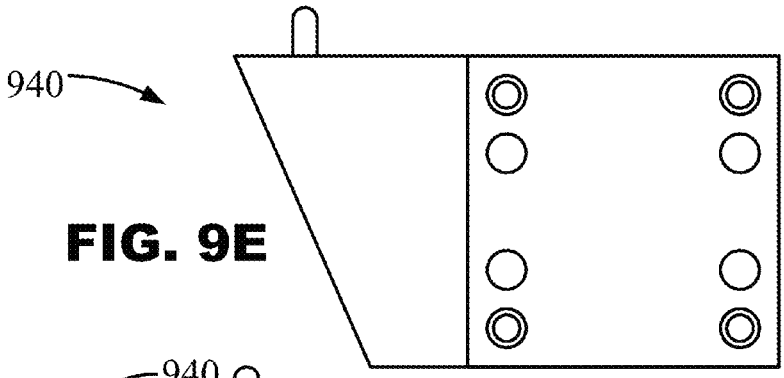
Figure 9F:
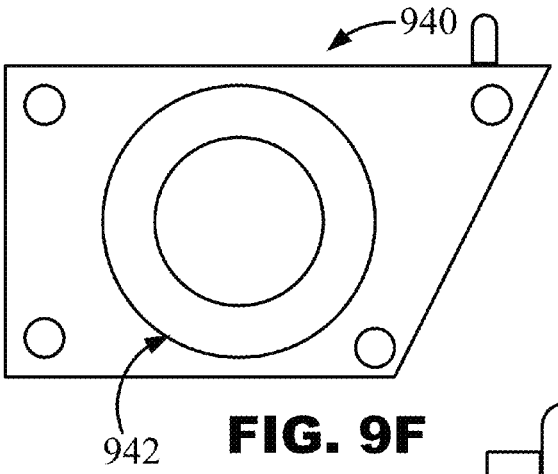
Figure 9G:
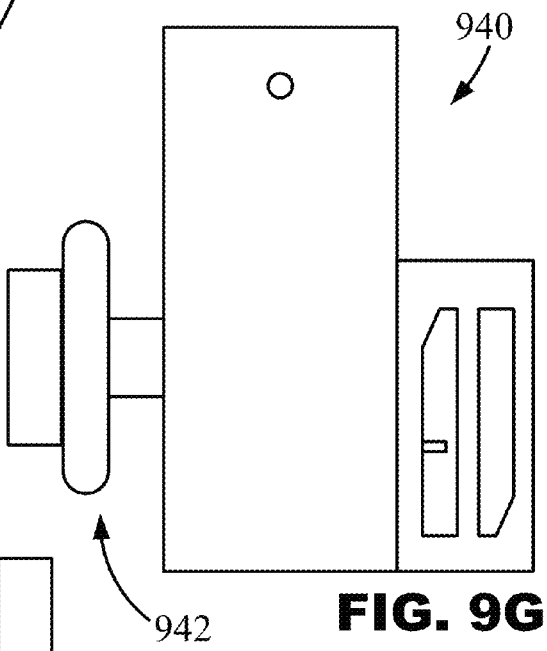
Figure 9H:
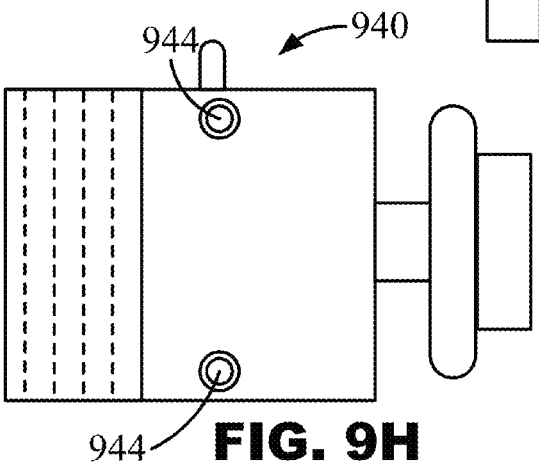

Motor housing 900 includes slots 924, 926 that are specifically shaped to receive ends of legs of the frame. The slots 924, 926 and ends of the legs are shaped such that the frame can only be assembled as intended. As shown in FIG. 9C, one of the slots 926 includes a post 928, which may function as a stop to limit insertion of the leg into the slot 926. In embodiments, both slots 924, 926 may include a post 928 or other stop feature. In embodiments, both slots 924, 926 may be tapered at one end. Additionally, the rear side 908 of motor housing 900 includes a set 930 of fastener-holes configured to receive fasteners (e.g., screws) for mounting a portion of a backing plate assembly (e.g., backing plate assembly 1002 depicted in FIG. 10A) thereto. Rear side 908 of motor housing 900 also includes a power switch 932, a power connector 934, and an optical sensor connector 936. A pin 938 may be disposed on the top side 910 of housing 900 and configured for mating with a receiving structure on a shield for coupling the shield to the housing 900.

FIGS. 9E-H show a mounting housing 940 with similar features of motor housing 900 shown in FIGS. 9A-D. Mounting housing 940 is intended to work in tandem with motor housing 900 to secure a tube of target paper therebetween, and includes a rotatable shaft assembly 942, as well as fastener-holes 944 for fixing another portion of the backing plate assembly thereto. The mounting housing 940 may also include a pin configured for assisting with mounting a portion of a shield thereon.

Figure 10A:
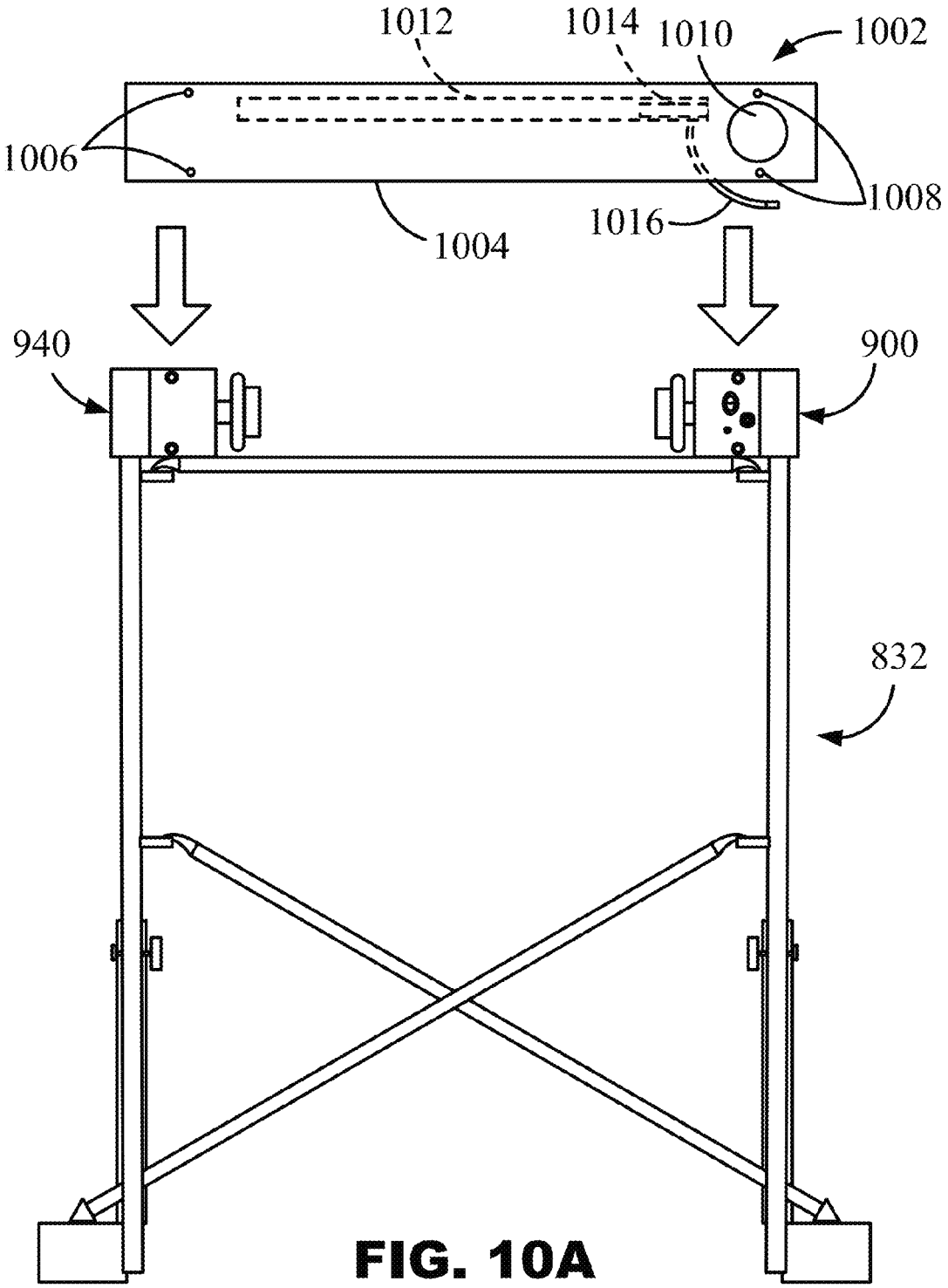
FIGS. 10A-B show various stages of assembling a target system, according to certain embodiments of the present disclosure.
Figure 10B:
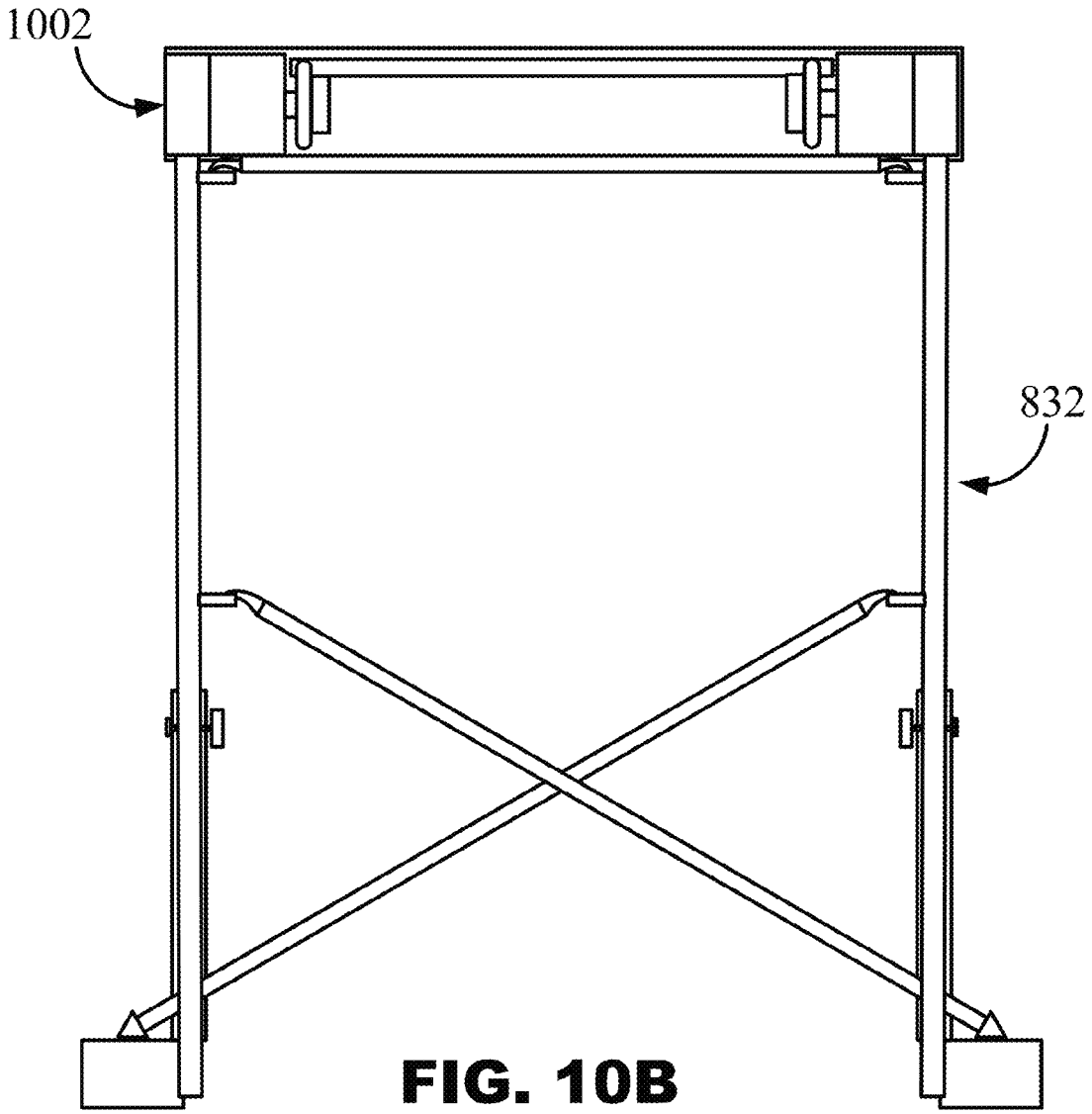
Figure 11A:
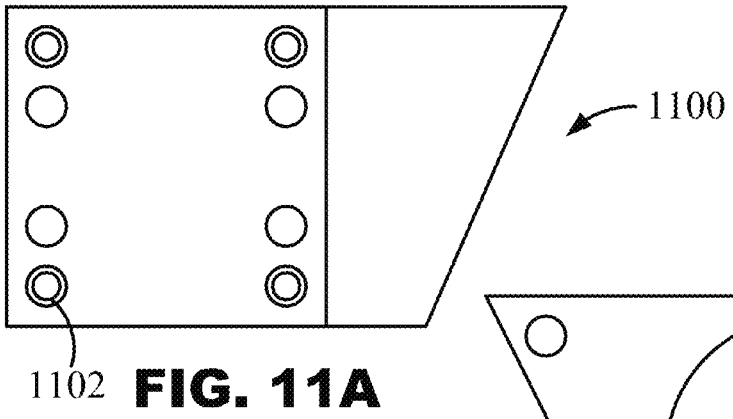
FIGS. 11A-H show various aspects of a housing of a roller section, show various stages of assembling a target system, according to certain embodiments of the present disclosure.
Figure 11B:
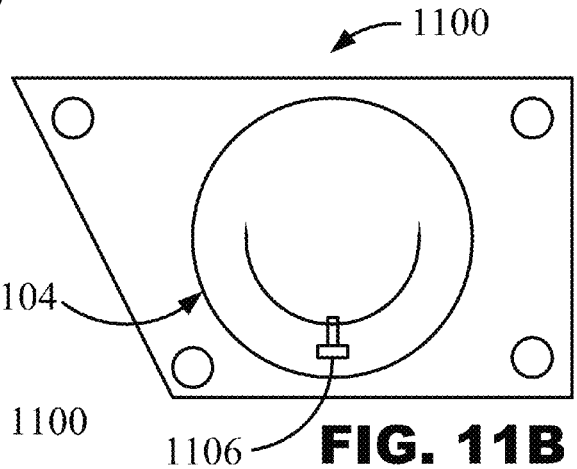
Figure 11C:
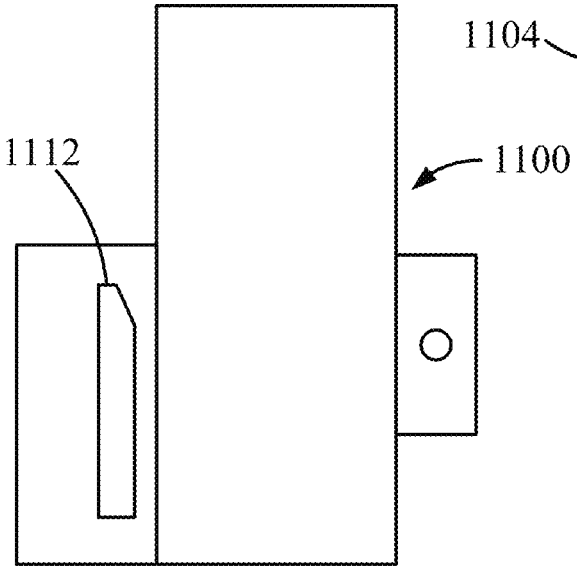
Figure 11D:
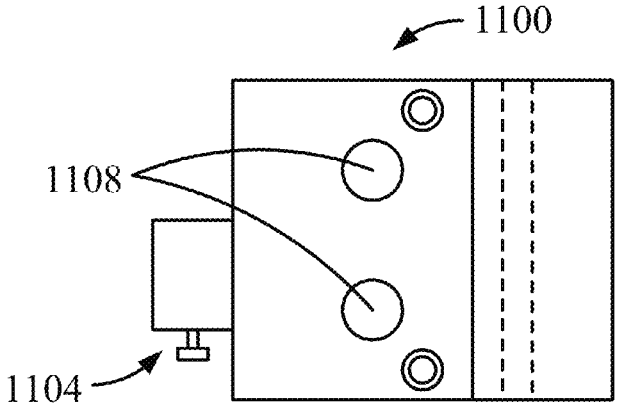
Figure 11E:
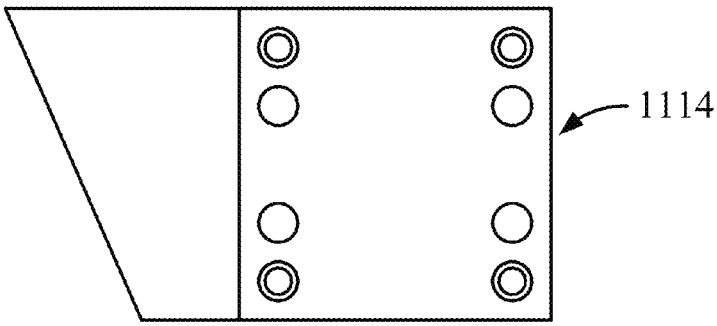
Figure 11F:
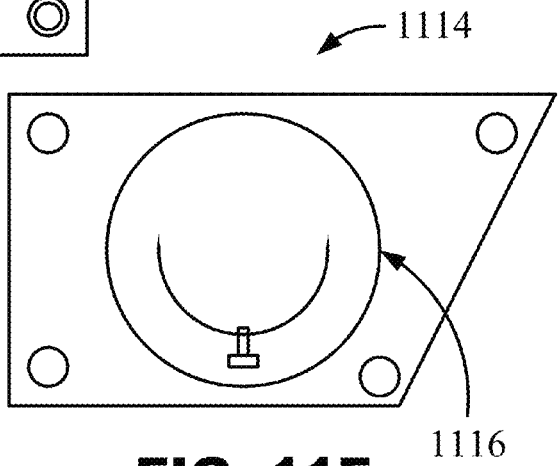
Figure 11G:
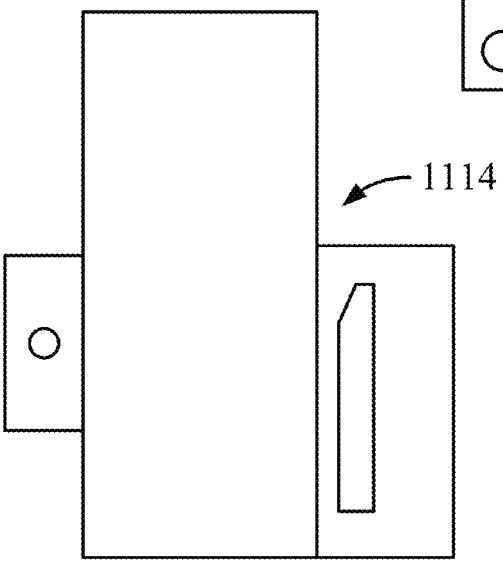
Figure 11H:
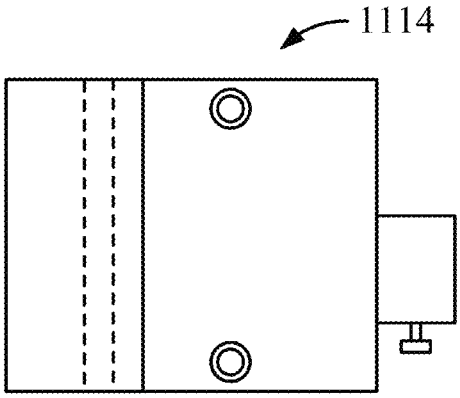

FIGS. 10A-B show stages of assembly of a bottom and middle section of a target system including motor housing 900 and mounting housing 940. The housings 900, 940 are coupled to the lower frame section 832. A lower backing plate assembly 1002 includes a plate 1004 that is coupled to the housings 940, 900 via fasteners that pass through fastener-holes 1006 and 1008, respectively. An aperture 1010 is disposed through the plate 1004 to allow access to the power switch and ports disposed on the back of the motor housing 900. A lower paper guide 1012 is disposed on a front side of the plate 1004 and includes an optical sensor 1014 coupled thereto (e.g., disposed within the lower paper guide 1012). An optical cable 1016 is configured to communicatively couple the optical sensor 1014 to the motor housing 900. FIG. 10B shows the lower backing plate 1002 coupled to the housings 900, 904 and lower frame section 832. Although not illustrated in FIGS. 10A and 10B, the motor housing 900 and mounting housing 940 may each include a pin for mounting a shield thereon, as discussed above. Any number of other techniques and/or mechanisms for coupling a shield to the system may be implemented in embodiments.

FIGS. 11A-H show various aspects of a housing of a roller section, show various stages of assembling a target system, according to certain embodiments of the present disclosure. FIGS. 11A-D show a housing 1100 for positioning on one side of a frame of a target system while FIGS. 11E-H show another housing 1114 for positioning on another side of the target system.

Housing 1100 includes leg adjustment mechanisms 1102 that may assist with securing the body to a leg. The body further includes a shaft assembly 1104 that is shaped to receive a tube of target paper. The shaft assembly 1104 can be moved towards the housing to insert a tube. Once inserted, the shaft assembly 1104 is spring loaded to provide a force that maintains a position of the tube in a horizontal or at least substantially horizontal position. Coupled to the shaft assembly is a tube fastener 1106, which assists with coupling a tube to the shaft assembly and/or aligning the target paper. In embodiments, the shaft assembly 1104 may not include a tube fastener 1106, and the system may rely on friction, interference fits, and/or the like to keep the target paper aligned. The fastener 1106 could be a thumb screw or other mechanism that couples a tube to the shaft assembly. The housing 1100 includes posts 1108 that can assist with aligning a backplate (e.g., backplate 1200 depicted in FIG. 12A), as described below. The housing 1100 also includes a slot 1112 shaped to receive a leg of the target system's frame.

FIGS. 11E-H show a housing 1114 with similar features to housing 1100 shown in FIGS. 11A-D. Housing 1114 with shaft assembly 1116 is intended to work in tandem with housing 1100 to secure a tube of target paper therebetween. The housings 1100, 1114 can be assembled to a top section of a target system's frame. Such a configuration is shown in FIGS. 12A-B—showing various stages of assembling a target system.

Figure 12A:
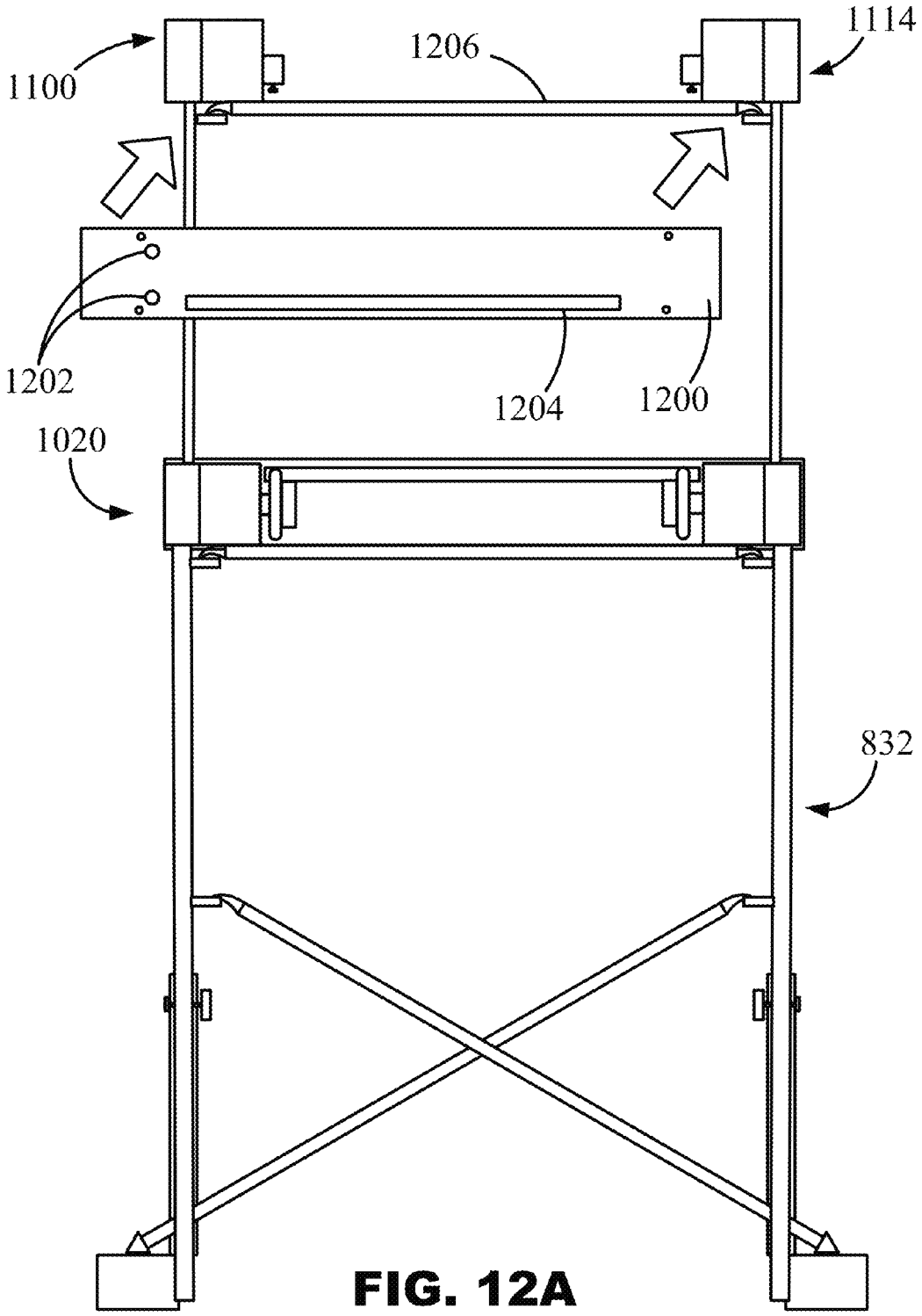
FIGS. 12A-B show various stages of assembling a target system, show various stages of assembling a target system, according to certain embodiments of the present disclosure.
Figure 12B:
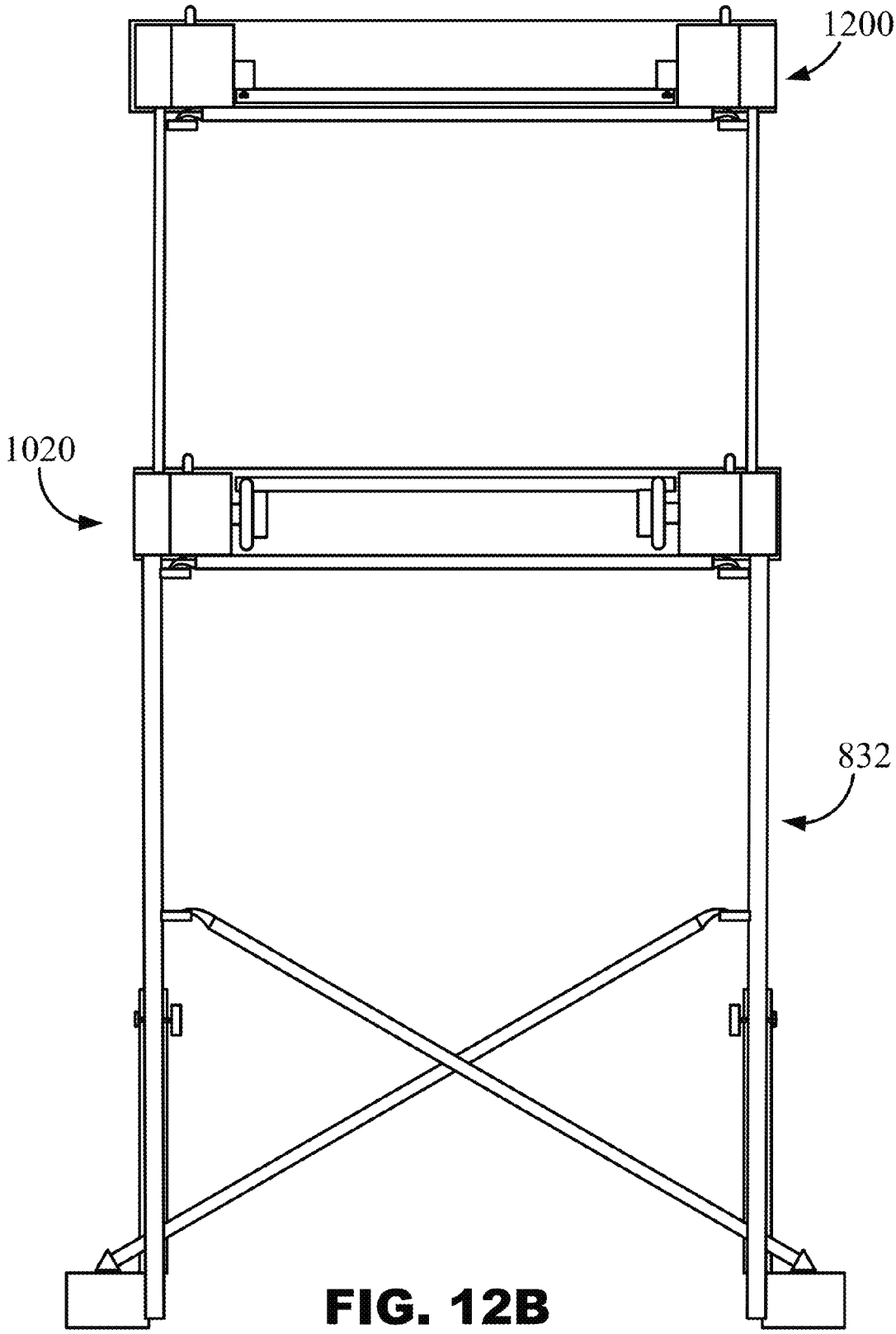

FIG. 12A features a backplate 1200 that is coupled to the housings 1100, 1114. The backplate 1200 forms guideholes 1202 that couple with posts 1108 to assist with aligning the backplate for simple fastening to the housings 1100, 1114. Backplate 1200 also includes a paper guide 1204 in which target paper is inserted through. A size of the paper guide 1204 can be adjusted via adjustment fasteners to create a desired amount of friction. For example, a certain amount of friction can assist with maintaining a position of the unrolled target paper. The upper section of the frame includes a cross stabilizer 1206 that provides lateral structure support. FIG. 12B shows the assembled frame and housing system, to which the paper targets, shields, and windscreens may be attached, as described herein.

Using various combinations of the above-described features and structures, a target system can be assembled and controlled remotely. Embodiments of the system may be assembled without the use of any tools. In certain embodiments, a target system includes a first roller section coupled to a top section of a frame and a second roller section coupled to a middle part of the frame, or vice versa. The first roller section may include two housings such as those shown in FIGS. 7A-B that are configured to receive a first tube having target paper rolled around the tube. The second roller section may include various structures for housing and positioning a motor, wireless receiver, battery, wireless receiver, and control circuitry. Although it has been discussed above that roller sections include multiple housing structures, each roller section may only use a single housing structure to support target paper and the various components used to rotate and control advancement of the target paper.

The second roller section may also include structures configured to receive a second tube having target paper rolled around the second tube. For example, a spring-loaded structure would allow a target shooter to press the spring-loaded structure in a horizontal direction to easily insert or remove tubes positioned between structures. In certain embodiments, an unrolled portion of the target paper would extend between the first and second roller sections and would feature several target patterns each with an associated detectable mark. The unrolled portion of target paper may be positioned between windscreens to assist with maintaining a position of the target.

In operation, the target system would start with a first target in an unrolled position between the first and second roller sections. After a target shooter is finished with the first target, the target shooter could press a button on a remote control to initiate a command signal to the wireless receiver. The present disclosure appreciates that other methods and devices can initiate and receive the command signal. In response to receiving a command signal, control circuitry could power the motor such that the motor rotates a shaft coupled to one of the tubes of target paper. The tubes of target paper would rotate and present a new target and associated detectable mark in the unrolled position. An optical sensor, like a photocell, aligned with the detectable mark could detect when the mark is positioned immediately adjacent to the sensor. Once the mark is detected, the control circuitry would power off the motor so that the new target is maintained in a desired position. The detectable marks could include a wide variety of marks that permit optical sensors to detect such marks. Moreover, other features than printed marks may be used to determine when target paper has reached a desired position. The target system could advance targets upwards rather than downwards. Moreover, a motor housing can be positioned at and coupled to various sections of the target system's frame.

Various modifications and additions can be made to the exemplary embodiments discussed without departing from the scope of the present disclosure. For example, while the embodiments described above refer to particular features, environments, and applications, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

I claim:

1. A system comprising:

a frame having a top, middle, and bottom section;

a first roller section coupled to the frame and positioned at the top section of the frame;

a second roller section coupled to the frame and positioned at the middle section of the frame;

wherein at least one of the first and second roller sections includes an optical sensor;

wherein the second roller section includes a motor housing positioned on a first side of the frame and including a motor, a battery, and a wireless receiver, and wherein the second roller section includes a spring-loaded housing positioned on a second side of the frame and including spring-loaded tube receiver;

wherein the frame includes a first set of legs on the first side of the frame and a second set of legs on the second side of the frame; and wherein the motor housing includes slots that couple the first set of legs to each other, and wherein the spring-loaded housing includes slots that couple the second set of legs to each other.

2. The system of claim 1, further comprising:

first and second windscreens coupled to the frame.

3. The system of claim 2, further comprising:

an anchoring structure coupled to the frame and positioned at the bottom section of the frame.

4. The system of claim 3, further comprising:

target paper positioned between the first and second windscreens.

5. The system of claim 4, wherein the target paper is part of a roll that extends from a first tube positioned within the first roller section to a second tube positioned within the second roller section.

6. The system of claim 5, wherein the second section includes the optical sensor, and wherein the motor includes a shaft coupled to the second tube.

7. The system of claim 6, further comprising:

control circuitry, wherein the control circuitry, battery, wireless receiver, motor, and optical sensor are electrically coupled together.

8. The system of claim 7, further comprising:

a remote control in communication with the wireless receiver, and wherein the wireless receiver is configured to receive commands from the remote control.

9. The system of claim 8, wherein the wireless receiver is configured to, in response to receiving a command from the remote control, initiate a power command to the control circuitry to power the motor such that the shaft and second tube rotate.

10. The system of claim 7, wherein the optical sensor is configured to detect a physical mark on the target paper, and wherein the control circuitry is configured to, in response to the optical sensor detecting the physical mark, initiate a stop command to the motor to stop rotation of the motor.

11. The system of claim 7, the first tube rests in a pocket positioned in the first roller section.

12. The system of claim 10, wherein both the first and second roller sections include angled shields comprising steel and rubber.

13. The system of claim 10, wherein both the first and second tubes are spring loaded into the first and second roller sections, respectively.

14. A method for using the system of claim 1, the method comprising:

sending a command signal to a wireless receiver positioned in the second roller section;

in response to receiving the command signal, sending a power signal to a motor positioned in the second roller section;

in response to receiving the power signal, rotating a shaft of a motor coupled to a roll of target paper;

rolling a first target into a rolled position; and unrolling a second target to an unrolled position.

15. The method of claim 14, further comprising:

detecting the detectable mark associated with the second target; and in response to the detecting step, stopping a motor from rotating the shaft.

* * * * *